US006931672B1

(12) United States Patent
Richter

(10) Patent No.: US 6,931,672 B1
(45) Date of Patent: Aug. 23, 2005

(54) BOLT ASSEMBLY FOR TOILET SEATS

(76) Inventor: Milton Richter, 34 Bennet St., Monticello, NY (US) 12701

( * ) Notice: Subject to any disclaimer, the term of this patent is extended or adjusted under 35 U.S.C. 154(b) by 24 days.

(21) Appl. No.: 10/840,120

(22) Filed: May 6, 2004

Related U.S. Application Data

(62) Division of application No. 10/434,047, filed on May 8, 2003, now Pat. No. 6,763,529.

(51) Int. Cl.[7] ..... A47K 13/12
(52) U.S. Cl. ..... 4/240; 4/236
(58) Field of Search ..... 4/234, 236, 237, 4/240

(56) References Cited

U.S. PATENT DOCUMENTS

| | | | | |
|---|---|---|---|---|
| 976,395 A | | 11/1910 | Pryor | 4/240 |
| 1,559,283 A | | 10/1925 | Schlegel | 4/240 |
| 1,799,309 A | | 4/1931 | Mears | 4/240 |
| 1,975,570 A | | 10/1934 | Edgcumbe | 4/236 |
| 3,254,363 A | | 6/1966 | Watson | 16/128 |
| 3,551,922 A | * | 1/1971 | Watson | 4/240 |
| 3,570,021 A | | 3/1971 | Watson | 4/240 |
| 4,079,471 A | | 3/1978 | Corda | 4/240 |
| 4,489,447 A | * | 12/1984 | Umehara | 4/240 |
| 4,820,096 A | | 4/1989 | Knight | 411/169 |
| 5,457,824 A | | 10/1995 | Reed | 4/234 |
| 5,933,875 A | | 8/1999 | Hulsebus et al. | 4/240 |
| 5,980,150 A | | 11/1999 | Newman et al. | 403/349 |
| 6,230,335 B1 | * | 5/2001 | Miller | 4/236 |
| 6,381,762 B1 | | 5/2002 | Moser | 4/240 |
| 6,637,040 B1 | * | 10/2003 | Alba | 4/240 |

FOREIGN PATENT DOCUMENTS

| | | | |
|---|---|---|---|
| GB | 2167096 | 5/1986 | A47K 13/12 |

* cited by examiner

*Primary Examiner*—Tuan Nguyen
(74) *Attorney, Agent, or Firm*—Sandra M. Kotin

(57) ABSTRACT

A bolt assembly for use with a toilet seat bracket that permits the toilet seat to be removed and replaced for cleaning without the necessity of reaching below the toilet bowl or toilet bowl flange and the method of using same. A threaded rod is passed through the flange and held in place with a first nut below the flange and a second nut above the flange. Once the rod is in place there is no reason to have to reach under the flange. The bracket of the toilet seat is then placed over the rod and secured with a third nut. A cap on the bracket conceals the rod and nut. The toilet seat can easily be removed by merely removing the third nut and lifting the seat off the flange. Another embodiment utilized a threaded opening in the toilet bowl flange so that a bolt can be admitted from above the flange to secure and remove the toilet seat. A further embodiment uses a tubular insert with a threaded inner wall affixed into the flange opening to receive the bolt.

8 Claims, 4 Drawing Sheets

FIG.2
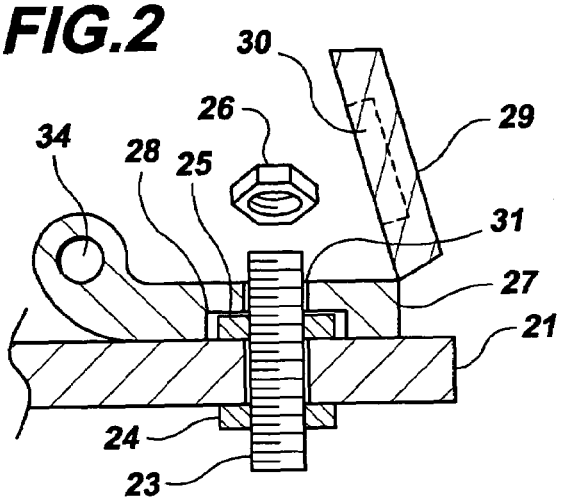
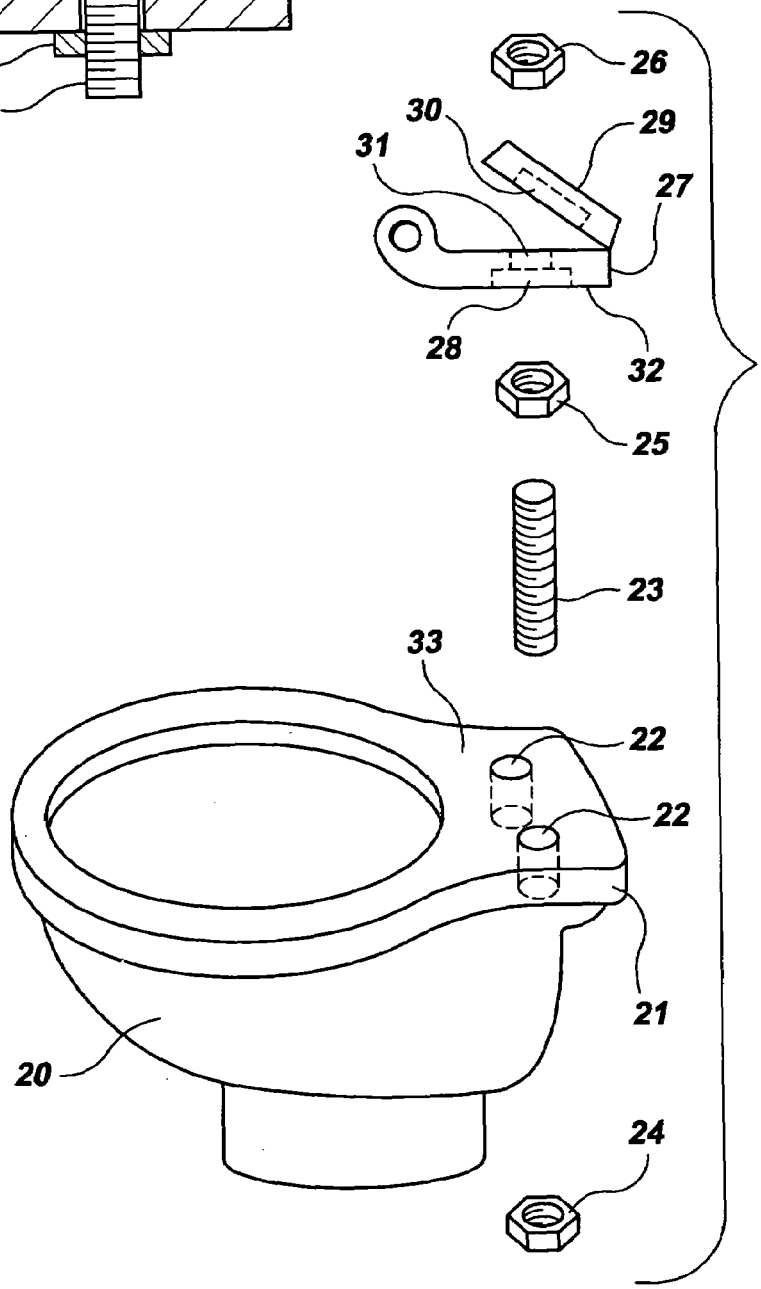
FIG.1

BOLT ASSEMBLY FOR TOILET SEATS

This application is a DIV of Ser. No. 10/434,047 filed May 8, 2003 now U.S. Pat. No. 6,763,529.

FIELD OF THE INVENTION

The instant invention relates to bolt assemblies for the attachment of toilet seats to the toilet bowl flange that enable installation and removal of the toilet seat from above the toilet bowl flange and the method of use of same.

BACKGROUND OF THE INVENTION

The common toilet seat assembly has been known for over a century. The installation of the toilet seat assembly has always required the installer to maneuver under the back end or flange of the toilet bowl or to reach under the flange. This type of installation has always made removal of the toilet seat assembly for cleaning a cumbersome task. The result has been that the seat assembly is usually only removed when there is a need to change it. Additionally, after remaining in place for a considerable period of time, the nuts and bolts that maintain the seat assembly in place are often badly corroded making removal very difficult, and more so when it is necessary to reach under the flange or get down beneath the flange to perform this task.

A patent to Pryor describes a seat assembly that is fastened to the rear flange of the bowl by downwardly facing screws and held within countersinks on the under side of the flange with washers and nuts. This arrangement requires the fastening of the nuts into the countersink from beneath the flange. (U.S. Pat. No. 976,395)

Another toilet bowl hinge arrangement is made of stamped metal that is secured to the bowl flange by a downwardly facing round headed carriage bolt having a square shoulder that fits into a square countersink in the top of the flange. The shank of the bolt is smooth with a threaded end portion. This bolt must be fastened in place under the flange and a nut is used that is flush with the bottom surface of the flange. (Mears, U.S. Pat. No. 1,799,309) In U.S. Pat. No. 4,820,096, Knight discloses a nut and bolt apparatus for use in securing a toilet seat assembly to the toilet bowl flange. A threaded bolt is passed downward through openings in the back of the seat assembly and the flange and is secured in place under the flange with a threaded nut having a horizontal arm. The nut is thereafter turned from below the flange until the arm contacts the lower surface of the bowl at which time it can no longer turn. The installer must then tighten the bolt from above. The upper part of the nut is conical so it may rest part way into the opening in the flange. When the bolt is tightened a part of the conical nut is drawn up into the opening for a tight fit. Though the bolt is tightened from above, the nut must still be seated and turned from beneath the flange. Newman et al., in U.S. Pat. No. 5,980,150, discloses a smooth cylindrical bolt having a linear key way near the bottom. The bolt is inserted through the holes in the seat assembly bracket and the bowl flange from above. Under the flange a spring is slipped over the lower portion of the bolt followed by a sleeve. The bolt can be given a quarter turn in the sleeve so the key way faces an axial opening wherein a threaded nipple locks the bolt in place. An installer would have to access the threaded nipple from below the flange in order to install the seat assembly or to remove it.

Watson, in U.S. Pat. No. 3,570,021, describes a toilet seat assembly that can be installed from above the flange. The seat assembly bracket has two downwardly projecting stems that fit into the stud holes in the toilet bowl flange. The stems have a flared opening at the bottom. A threaded bolt held in place with a nut is placed into each stem before the seat assembly is put in place. Once in place the bolts are tightened within the stems pulling the nuts up into the flared opening and in turn forcing the walls of the stem to flare out against the stud holes to secure the seat assembly in place. Such an assembly is also subject to rusting which will render it impossible to remove the assembly. Frequent removal and replacement can strip the inside of the stem causing fatigue which will no longer permit tightening of the nut. A seat assembly that can be easily removed and replaced is taught by Corda in U.S. Pat. No. 4,079,471. A threaded post having a smooth upper portion extending above a flat bushing is set into each hole in the bowl flange and secured with a nut from below. The bracket of the seat assembly has two smooth walled cylindrical bushings that fit over the smooth upper portions of the posts enabling the seat assembly to be taken off and replaced while the bolt remains in place. After time the connections can become loose so that the seat assembly will no longer be held securely in place. A similar arrangement is taught by Hulsebus et al. in U.S. Pat. No. 5,933,875 where a bolts are passed downward through base members and the holes in the bowl flange and are secured with nuts under the flange. Locking members that cooperate with the base members above the flange fasten the seat assembly in place. The locking members enable the seat assembly to be removed and replaced. See also U.S. Pat. No. 6,381,762 to Moser.

Another system that enables removing the seat assembly from above the flange is disclosed by Reed in U.S. Pat. No. 5,457,824. A hollow bolt threaded on its outer surface and smooth on its inner surface is placed into each hole in the flange and must be secured with a nut from below the flange. The seat assembly mounting bracket is placed over the two bolts and a hollow pin is placed into each bolt. A screw is then placed into each pin and turned so the walls of the pin are forced against the inner sides of the hollow bolt to secure the seat assembly. A similar system is disclosed in UK Patent Application GB2 167 096 A. Such systems will exhibit fatigue after the seat assembly is repeatedly removed and replaced.

Edgcumbe discloses a toilet seat hinge assembly that is affixed to the bowl flange by bolts that have smooth stems and threaded ends. The bolts are introduced upwardly into the holes in the bowl flange from below the flange and the threaded ends must be screwed into cooperating covered threaded channels in the seat assembly brackets. The openings in the underside of the brackets must be placed exactly over the holes to accept the bolts. These bolts must be introduced from the underside of the flange and tightened from the underside of the flange. There is no access to the bolts from above. (U.S. Pat. No. 1,975,570) In U.S. Pat. No. 3,254,363 Watson discloses using a threaded studs that are screwed directly into sockets on the underside of the hinge posts of the seat assembly. The studs are then lowered into the holes in the bowl flange. A soft washer must be pushed up onto each stud from below the flange followed by plastic nuts having toothed top surfaces. As the nuts are tightened on the studs from below the flange the teeth grip the soft washer and force is exerted on the stud pulling it downward for a tight fit.

Schlegel, in U.S. Pat. No. 1,559,283 teaches the use of a bolt with a square shank and a round threaded end that is inserted upward into the holes in the bowl flange from below. The flange holes are also square so the bolts cannot rotate once set in place. The threaded end passes through openings in the back of the seat assembly and are maintained in place by closed nuts having a lubricant reservoir in the top to prevent rusting. When the seat assembly is to be removed, the nuts can be taken off from above, but the bolts must be caught from below or they will fall to the floor. The fixed length of the bolts cannot accommodate variations in the thickness of the flange that may occur from one toilet bowl assembly to another.

Most of the prior art patents disclose a system whereby the seat assembly can be removed for cleaning and replaced only by gaining access to removable nuts situated under the flange where space is usually very limited and access is difficult. Even those prior art systems that enable removal of the seat assembly from above the flange require setting the main bolts with nuts that are screwed on from below. Many seat assemblies currently on the market come with two downwardly facing bolts permanently attached to the seat brackets. These bolts must be inserted downwardly into the flange openings and fastened with nuts from below the flange. The only way to remove these seat assemblies is to reach under the flange to remove the two nuts. After time the nuts and bolts often become severely corroded making the removal of the seat assembly even more difficult.

With present day requirements for sanitary provisions that were not necessary only a few years ago there is a need for a bolt arrangement to affix a toilet seat assembly to the bowl flange that enables the seat assembly to be easily removed for cleaning and where the access to the fastening bolts for the removal of the seat assembly is made from above the flange. There is a need for such a system that is compatible with existing toilet bowl fixtures.

BRIEF SUMMARY OF THE INVENTION

The present invention provides a bolt arrangement for use in fastening a toilet seat assembly to the flange of the bowl without the need to get under the flange. This bolt arrangement enables the easy removal and replacement of the entire seat assembly from above the bowl flange and makes removal of the toilet seat for cleaning a very simple operation.

It is an object of the present invention to provide a quick and easy means to remove and replace a toilet seat assembly.

Another object of the present invention is to provide a simple bolt assembly that is compatible with present fixtures.

A further object of the present invention is to provide a bolt assembly that can be easily removed even if the nut under the flange has rusted.

A still further object of the present invention is to provide a bolt assembly that enables the placement and removal of a toilet seat assembly without having to reach or access under the bowl flange.

Another object of the present invention is to provide a bolt assembly that is inexpensive and easy to manufacture.

The invention is an assembly designed to reversibly accept a toilet seat that comprises a toilet bowl with a rear flange having at least one cylindrical vertical opening through it, and at least one rod substantially longer then the thickness of the flange and dimensioned to be received within the vertical opening. The is rod threaded on its outer surface and there is thread means disposed within the vertical opening for cooperation with the threaded rod and for securely retaining the threaded rod within the vertical opening. There is at least one toilet seat bracket to which the toilet seat is attached. The bracket is for securing the toilet seat to the toilet bowl flange, and the bracket comprises attaching means to attach said bracket to the toilet seat, a base member having a top surface and a bottom surface and an opening therethrough, said opening being large enough for the rod to pass through, and a cap. When the toilet seat is placed on the flange so the opening in the bracket communicates with the vertical opening in the flange, the rod can be passed through the opening in the bracket into the vertical opening in the flange a sufficient distance such that the rod is secured therein by cooperation with the thread means and the top of the rod projects above the top surface of the bracket and can be covered by the cap, and thereafter, the toilet seat can be removed from the toilet by removing the cap and lifting it from above the flange and can easily be replaced thereon.

The invention also includes a method for reversibly attaching a toilet seat assembly having at least one attaching bracket with an aperture therethrough to a toilet bowl flange. The method comprising the steps of obtaining a toilet bowl with a flange having at least one vertical opening, said opening having thread means therewithin; obtaining a threaded rod having a top end and a bottom end, being substantially longer than the thickness of the flange and being dimensioned to pass through the aperture in the bracket and to cooperate with the thread means in the opening in the flange; placing the toilet seat assembly on the toilet bowl so the bracket rests on the flange and the opening in the bracket communicates with the opening in the flange; passing the bottom end of the rod downward through the opening in the bracket and into the opening in the flange; rotating the rod so that the threading of the rod cooperates with the thread means in the flange opening; continuing the rotation until the rod is secured within the opening and only a portion of the rod projects above the bracket; and lifting the toilet seat assembly away from the toilet bowl flange. The toilet seat assembly can be easily and repeatedly replaced on and removed from the toilet bowl flange from above the flange with no need to reach beneath the flange.

Other features and advantages of the invention will be seen from the following description and drawings.

BRIEF DESCRIPTION OF THE DRAWINGS

FIG. 1 is an exploded view of the bolt assembly of the present invention shown with toilet bowl and seat assembly bracket;

FIG. 2 is side partial cutaway side view of the invention of FIG. 1;

DETAILED DESCRIPTION OF THE INVENTION

Figure 3:
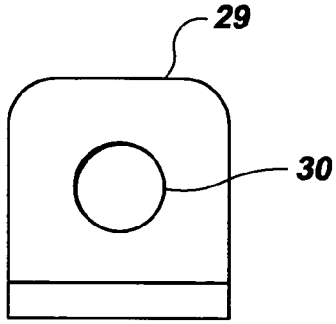
FIG. 3 is an exploded view of a second embodiment of the present invention.

The bolt assembly of the present invention may be designed to enable rapid and easy removal of the toilet seat for cleaning as well as easy replacement of the toilet seat thereafter. The first embodiment of the invention (FIGS. 1 and 2) may be used with any conventional toilet bowl 20 having a rear flange 21 with two vertical cylindrical openings 22 in the flange 21. The design may insure compatability with toilet fixtures having flanges of different thickness. Though the initial seating of the bolt may require minimal access below the flange of the toilet bowl, the removal and replacement of the toilet seat may be accomplished without any further need to reach below or to gain access below the flange.

A threaded rod 23 (which may also be described as a headless bolt) may be passed through one of the openings 22 in the flange 21 and a first nut 24 may be affixed to the rod 23 from below the flange 21. However, since it is the intention of the present invention to eliminate the need to perform any work from below the flange 21, the first nut 24 may be threaded onto the bottom of the rod 23 and then the rod 23 may be inserted upwardly into the opening 22 from beneath the flange 21. To hold the rod 23 in place, a second nut 25 is threaded onto the rod 23 from above the flange 21 until the second nut 25 is flush with the top surface of the flange 21. The rod 23 may be made long enough to allow for variations in the thickness of the flange 21 and variations in the thickness of the toilet seat brackets used to affix the toilet seat assembly to the toilet bowl flange.

The toilet seat (not illustrated) may be affixed to the toilet bowl 20 by means of brackets 27 that have openings 31 of a diameter substantially the same as the openings 22 in the flange 21. These brackets 27 may be set onto the portions of the rods 23 that extend above the flange 21. Once this is accomplished, a third nut 26 may be threaded onto the top of each rod 23 so that the brackets 27 and thereby the toilet seat are securely maintained in place. The first nut 24 and second nut 25 may be threadedly adjusted on the rod 23 such that a sufficient portion of the rod 23 extends above the second nut 25 to accommodate the toilet seat bracket 27 and the third nut 26. Once the rod 23 is properly positioned there may be no further need to rotate the rod 23 or the first nut 24 or second nut 25 or to reach under the flange when the toilet seat is removed or replaced. The top of the rod 23 may be substantially flush with the top of the third nut 26 when the installation is completed. Any toilet seat assembly having two securing brackets with openings corresponding to the vertical openings 22 in the toilet bowl flange 21 may be secured to the flange 21 with the bolt assembly of the present invention.

Modifications made to the brackets 27 to accommodate the bolt assembly may provide a more aesthetic result. The brackets 27 may have countersinks 28 on their undersurfaces so that the second nuts 25 may be disposed within the countersinks 28 thus enabling the bottom surfaces 32 of the brackets 27 to lie flush against the upper surface 33 of the flange 21. The brackets 27 may have apertures 34 to accept the pivot rods or means (not shown) that connect the brackets 27 to the toilet seat.

Figure 4:
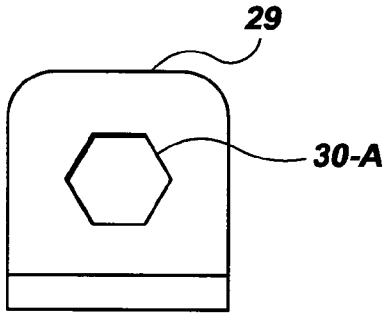
FIG. 4 is a bottom plan view of one variation of the inside of the bracket cap.

There may be a cap 29 pivotally attached to the bracket 27 to cover the top of the rod 23 and the third nut 26 and to provide a more pleasing appearance to the entire fixture. The cap 29 may have a recess 30 on the underside that may be dimensioned to contain the third nut 26 so that the cap 29 is flush with the upper surface of the bracket 27. The recess 30 in the underside of the cap 29 may be larger than the third nut 26 and merely serve to accept the third nut 26 (FIG. 3) or it may have a specific shape 30-A and be dimensioned to hold the third nut 26 securely so that it may not rotate (FIG. 4).

The removal of the toilet seat for cleaning may merely require that the third nuts 26 be removed and the toilet seat be lifted off the flange 21. When the brackets 27 described above are used the seat assembly may be removed by raising the cap 29 of each bracket 27, removing the third nuts 26 and lifting the toilet seat with the brackets 27 attached upward over the rods 23. When cleaning is completed the toilet seat may be replaced with ease and with no need to reach under or lean under the toilet bowl flange 21.

Figure 5:
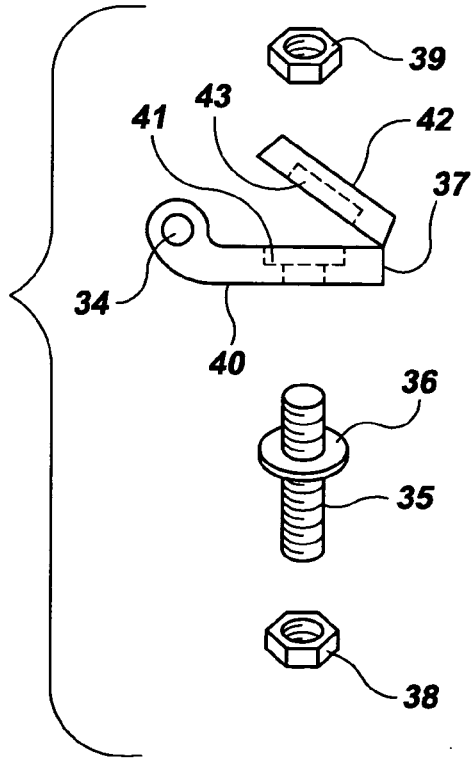
FIG. 5 is a bottom plan view of another variation of the inside of the bracket cap.

A second embodiment of the present invention may utilize a threaded rod 35 with a washer 36 or other stop means affixed to the rod 35 at a point along its length. The washer may divide the length of the rod 35 into a shorter upper portion and a longer lower portion. (FIG. 5) The rod 35 may be inserted downwardly into an opening 22 in the flange 21 until the washer 36 contacts the upper surface of the flange 21 and the rod 35 can move no further. The rod 35 may be secured to the flange 21 using a bottom nut 38 which may be threaded onto the rod 35 from below the flange 21. Once secured in place, the rod 35 may not have to be removed or adjusted when the toilet seat is removed for cleaning, and there may be no further need to reach below the flange 21. It may be preferable to have a longer bottom portion as opposed to having a fixed stop or washer below the flange 21 because there may be variations in the thickness of the flange 21 from one toilet fixture to another and it may be desirable to provide the excess length to the portion of the rod 35 that extends below the flange 21 since any excess length in the rod 35 lying below the flange may not be seen. Placing a fixed stop at the bottom of the rod 35 may result in too much excess length extending above the flange 21 which may be unsightly and may not be concealed by the cap.

The washer 36 may be affixed at a specific distance below the top of the rod 35 so that a sufficient portion of the rod 35 may extend above the flange 21 to accommodate the toilet seat bracket 37 and a top nut 39 which is used to secure the bracket 37 in place. Once the seat is secured the top of the rod may be substantially flush with the top of the top nut 39.

The washer 36 may be flat so that a countersink on the under surface 40 of the bracket 37 may not be necessary. There may be a countersink 41 in the upper surface of the bracket 37 to accept the top nut 39. There may be a cap 42 pivotally affixed to the bracket 37 to conceal the the top nut 39. The cap 42 may have a recess 43 on the underside to accept the top nut 39 and any minimal portion of the top of the rod 35 that may extend therebeyond.

The removal of the toilet seat assembly from the second embodiment may be accomplished in much the same manner as the first embodiment. The caps 42 may be raised, the top nuts 39 removed, and the toilet seat lifted off the rods 35. Again, there may be no need to reach beneath the toilet seat flange once the rod 35 is secured in place.

Figure 6:
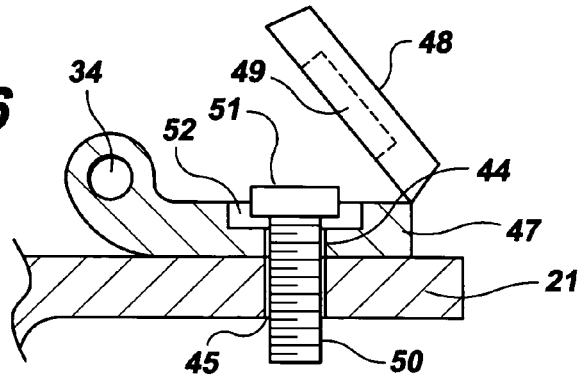
FIG. 6 is a side partial cutaway side view of third embodiment of the present invention.
Figure 7:
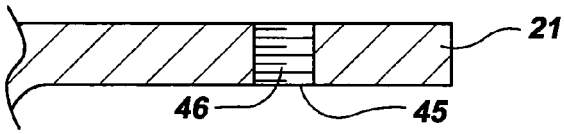
FIG. 7 is a side cutaway view of the threaded flange opening.

In a third embodiment of the present invention the openings 45 in the toilet bowl flange 21 may be threaded (FIG. 7). The threading may be accomplished during the manufacture of the toilet bowl and may be made in the material of the fixture itself or by affixing tubes with threaded interiors within the flange openings 45. The threads 46 may be made uniform from one fixture to another and further may be of a standard thread size and bore. The toilet seat assembly may be placed on the flange 21 such that the openings 44 in the seat assembly bracket 47 communicate with the openings 44 in the flange 21. Threaded bolts 50 may be inserted downwardly from above through the openings 44 in the toilet seat bracket 47 and screwed into the threaded openings 45 in the flange 21 (FIG. 6). Variations in the thickness of the flange 21 may not pose a problem since any excess length of the bolt 50 may extend below the flange 21 out of sight and without interfering with any other parts of the system. The heads 51 of the bolts 50 may be configured to require the use of a screw driver or a wrench for tightening or may be of a thumb screw design so they may be tightened and loosened by hand. There may be a countersink 52 in the top of the bracket 47 to accept the head 51 of the bolt 50. A hinged cap 48 affixed to the bracket 47 may have a recess 49 on the under surface to accept any portion of the head 51 that is not seated within the recess 52. The cap 48 may insure that the bolt 50 is hidden from view. The removal of the seat assembly may be easily and reversibly accomplished by merely raising the caps 48, removing the bolts 50 and lifting the seat assembly off the flange 21.

Figure 8:
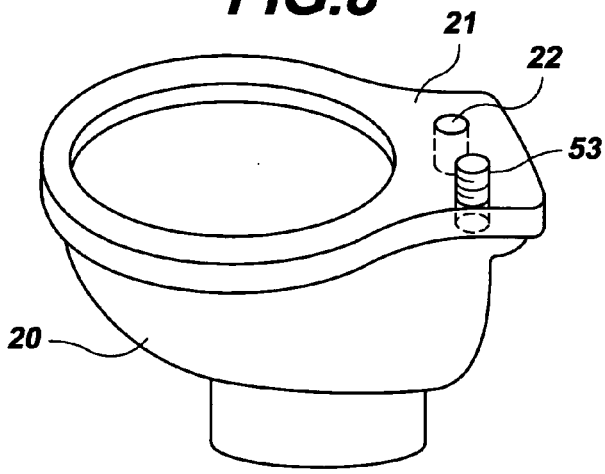
FIG. 8 is a perspective view of a toilet bowl with the hollow bolt in place.
Figure 9:
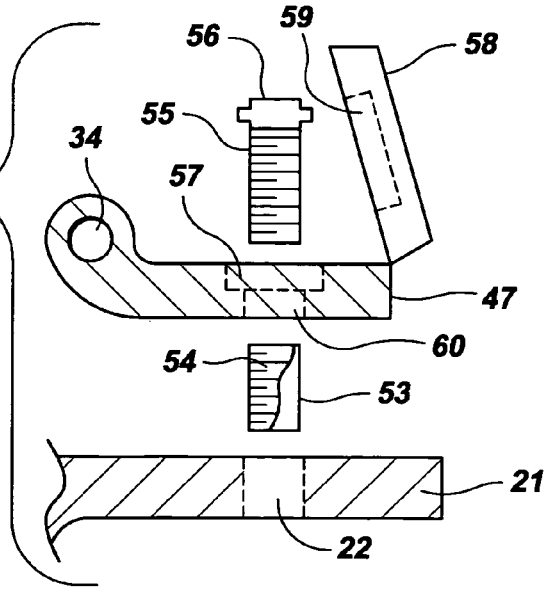
FIG. 9 is an exploded view of the embodiment of the present invention utilizing the hollow bolt.

A fourth embodiment utilizes the principals of the third embodiment, but precludes the necessity of altering the standard toilet bowl assembly during manufacture. Tubular inserts 53 may be fabricated to fit into the openings 22 in the toilet bowl flange 21. (FIGS. 8 and 9) The inserts 53 may have substantially smooth or textured outer walls with threads 54 on their inner walls. The inserts 53 may be permanently seated into the openings 22 using any appropriate adhesive known in the art. FIG. 8 shows one opening 22 without the insert and one opening with the insert 53. Once the inserts 53 are seated, the toilet seat assembly may be put in place by setting the brackets 47 on the flange 21 such that the openings 60 in the brackets 47 communicate with the openings 22 in the inserts 53. Headed bolts 55 may then be passed through the openings 60 in the brackets 47 and screwed into the threads 54 on the interior walls of the inserts 53 until the heads 56 of the bolts 55 are flush within countersinks 57 in the top surface of the brackets 47. The toilet seat may be removed by unscrewing the bolts 55 and lifting off the toilet seat. The heads 56 of the bolts 55 may be structured to require a screw driver, a wrench or may have a wing configuration for tightening by hand.

Figure 10:
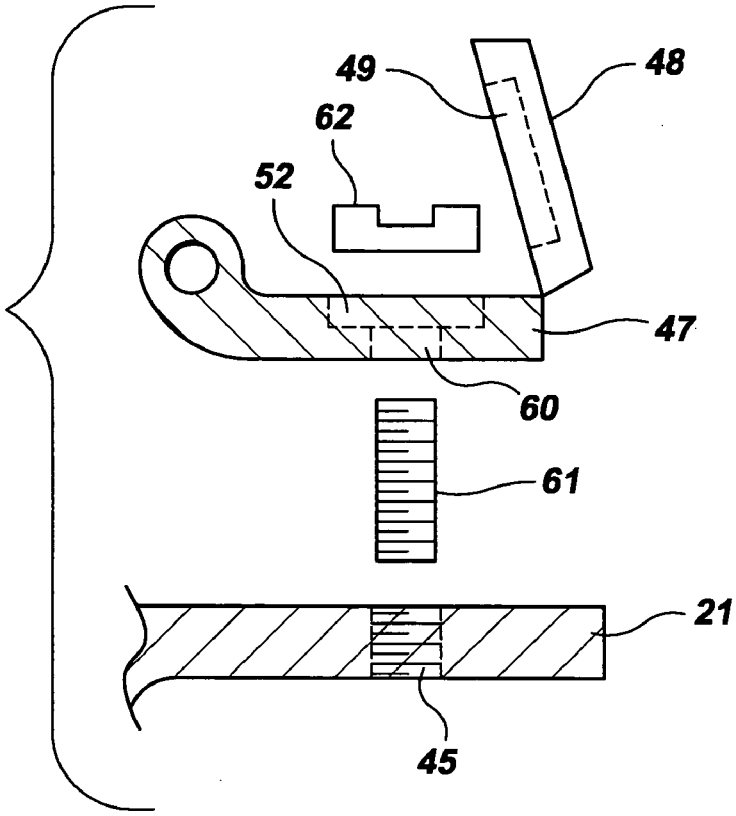
FIG. 10 is an exploded view of another embodiment of the present invention.
Figure 11:
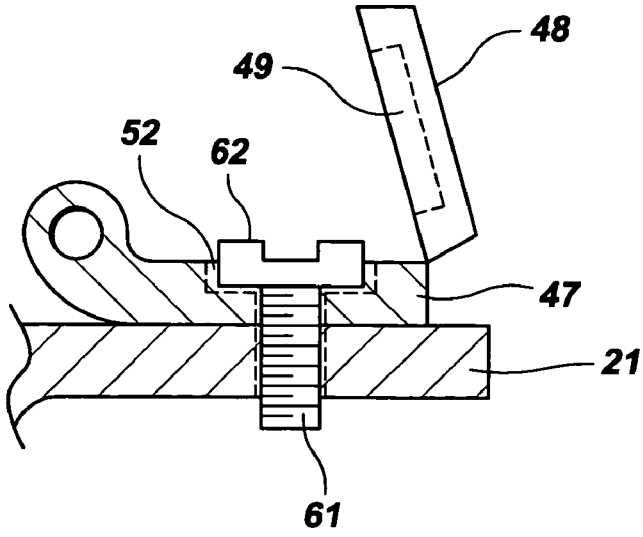
FIG. 11 is a side partial cutaway view of the embodiment of FIG. 10.

A fifth embodiment shown in FIG. 10 may utilize threaded rods 61 (headless bolts) that may cooperate with threaded openings 45 in the toilet bowl flange 44 as noted above and illustrated in FIG. 7. The rods 61 may be threaded into the openings 45, the toilet seat put into place by setting the brackets 47 over the rods 61 so the tops of the rods 61 extend upward through the openings 60 in the brackets 47. The toilet seat may be maintained in place by means of wing nuts 62 that may be threaded onto the tops of the rods 61 and tightened by hand. The tops of the rods 61 may extend above the brackets 47 just enough for the wing nuts 62 to be fastened in place. If too much of the rods 61 are exposed, the rods 61 may be rotated within the threaded openings 45 until the desired amounts of the rods 61 extend above the brackets 47. The wing nuts 62 may fit into the countersinks 52 in the brackets 47 and caps 48 may be used to conceal the wing nuts 62 by means of recesses 49 in the undersides of the caps 48. This variation, using the wing nut 62 may permit the seat assembly to be removed without the need for any tools. The threaded rods 61 and wing nuts 62 may also be used with the tubular inserts 53 as described above. The rods 61 may also be permanently installed within the openings 45 in the flange 21 using any suitable adhesive known in the art with sufficient lengths of the rods 61 extending above the flange 21 to permit installation of the brackets 47 and wing nuts 62. (FIG. 11) All of the above described variations may permit the removal and replacement of the toilet seat assembly from above the flange 21.

The threaded rods and bolts of the instant invention may be made of metal or polymeric materials that are strong, rigid and wear resistant. Any of the embodiments requiring a top or third nut may have a wing nut so that no tools are needed to remove and replace the seat assembly. If wing nuts are used, the size and configuration of the concealing caps may be made accordingly.

There may be minimal need to reach under the toilet bowl flange to secure the threaded rods in some of the embodiments of the present invention. Other embodiments are designed so there may be no need to reach under the flange at all. In all embodiments, once the bolts are in place the seat assembly may be secured in place and thereafter removed and replaced for cleaning as often as needed with no need to reach below the flange.

While several embodiments of the present invention have been illustrated and described in detail, it is to be understood that this invention is not limited thereto and may be otherwise practiced within the scope of the following claims.

What is claimed is:

1. An assembly that reversibly accepts a toilet seat comprising:

a toilet bowl with a rear flange having at least one cylindrical vertical opening therethrough;

at least one rod substantially longer then the thickness of the flange and dimensioned to be received within the vertical opening, said rod being threaded on its outer surface;

thread means disposed within said vertical opening for cooperation with said threaded rod and for securely retaining said threaded rod within the vertical opening; and at least one toilet seat bracket to which the toilet seat is attached, said bracket for securing the toilet seat to the toilet bowl flange, and said bracket comprising attaching means to attach said bracket to the toilet seat, a base member having a top surface and a bottom surface and an opening therethrough, said opening being large enough for the rod to pass through, and a cap;

whereby when the toilet seat is placed on the flange so the opening in the bracket communicates with the vertical opening in the flange, the rod can be passed through the opening in the bracket into the vertical opening in the flange a sufficient distance such that the rod is secured therein by cooperation with the thread means and the top of the rod projects above the top surface of the bracket and can be covered by the cap, and thereafter, the toilet seat can be removed from the toilet by removing the cap and lifting it from above the flange and can easily be replaced thereon.

2. An assembly as in claim 1 wherein the thread means comprises threading disposed about the walls of the vertical opening in the flange, said threading sized to cooperate with the threading on the outer surface of the rod.

3. An assembly as in claim 1 wherein the thread means comprises a tubular insert disposed within the walls of the vertical opening in the flange, said insert having a substantially smooth exterior wall and a threaded interior wall, said threading sized to cooperate with the threading of the outer surface of the rod, and adhesive means for permanently securing the insert within the vertical opening.

4. An assembly as in claim 1 further comprising a threaded wing nut configured to be threaded onto the top of the rod to secure the toilet seat to the flange and whereby the toilet seat can be removed, replaced and secured from above the flange by removing and replacing the wing nut, the bracket and therewith the toilet seat.

5. An assembly as in claim 1 further comprising a countersink in the top surface of the bracket surrounding the opening.

6. A method for reversibly attaching a toilet seat assembly having at least one attaching bracket with an aperture therethrough to a toilet bowl flange, said method comprising the steps of:

obtaining a toilet bowl with a flange having at least one vertical opening, said opening having thread means therewithin;

obtaining a threaded rod having a top end and a bottom end, being substantially longer than the thickness of the flange and being dimensioned to pass through the aperture in the bracket and to cooperate with the thread means in the opening in the flange;

placing the toilet seat assembly on the toilet bowl so the bracket rests on the flange and the opening in the bracket communicates with the opening in the flange;

passing the bottom end of the rod downward through the opening in the bracket and into the opening in the flange;

rotating the rod so that the threading of the rod cooperates with the thread means in the flange opening;

continuing the rotation until the rod is secured within the opening and only a portion of the rod projects above the bracket; and lifting the toilet seat assembly away from the toilet bowl flange;

whereby the toilet seat assembly can be easily and repeatedly replaced on and removed from the toilet bowl flange from above the flange with no need to reach beneath the flange.

7. A method for reversibly attaching a toilet seat assembly to a toilet bowl as in claim 6 further comprising the steps of:

obtaining a concealing cap;

placing the concealing cap over the projecting end of the rod and insuring that the top end of the rod is in clearance relation to the underside of the concealing cap;

removing the concealing cap; and lifting the toilet seat assembly from the flange;

whereby the toilet seat assembly can be easily and repeatedly replaced on and removed from the toilet bowl flange with no need to reach beneath the flange.

8. A method for reversibly attaching a toilet seat assembly to a toilet bowl as in claim 6 further comprising the steps of:

obtaining a wing nut sized to cooperate with the rod;

screwing the wing nut over the projected end of the rod and insuring that the underside of the wing nut is in contact with the upper surface of the bracket;

removing the wing nut; and lifting the toilet seat assembly from the flange;

whereby the toilet seat assembly can be easily and repeatedly replaced on and removed from the toilet bowl flange with no need to reach beneath the flange.

* * * * *